US005874808A

United States Patent [19]

Busta et al.

[11] Patent Number: 5,874,808

[45] Date of Patent: Feb. 23, 1999

[54] LOW TURN-ON VOLTAGE VOLCANO-SHAPED FIELD EMITTER AND INTEGRATION INTO AN ADDRESSABLE ARRAY

[76] Inventors: Heinz H. Busta, 223 N. Home Ave., Park Ridge, Ill. 60068; Jay E. Pogemiller, 1402 Whittingham Dr., Tracy, Calif. 95376

[21] Appl. No.: 916,370

[22] Filed: Aug. 21, 1997

Related U.S. Application Data

[63] Continuation-in-part of Ser. No. 759,725, Dec. 15, 1996, abandoned.

[51] Int. Cl.[6] ..... H01J 1/30

[52] U.S. Cl. ..... 315/169.1; 315/334; 313/351

[58] Field of Search ..... 315/169.1, 169.2, 315/169.3, 169.4, 334–337; 313/351

[56] References Cited

U.S. PATENT DOCUMENTS

| | | | |
|---|---|---|---|
| 3,665,241 | 5/1972 | Spindt et al. | 313/351 |
| 5,227,699 | 7/1993 | Busta | 315/291 |
| 5,229,331 | 7/1993 | Doan et al. | 437/228 |
| 5,382,185 | 1/1995 | Gray et al. | 445/49 |
| 5,559,389 | 9/1996 | Spindt et al. | 313/310 |
| 5,791,962 | 8/1998 | Liu et al. | 445/50 |

OTHER PUBLICATIONS

Baran, "LCD's and Beyond", Feb. 1991, pp. 229–236, *Byte*.

Baran, "Competition for Active Matrix", Jan. 1994, p. 24, *Byte*.

Pogemiller, et al, "Gated Chromium Volcano Emitters", Mar./Apr. 1994, pp. 680–684, *J. Vac.Sci.Technol.B* , vol. 12, No. 2.

Schofield, "Phosphors May Improve Laptop Screens", Dec. 16, 1996 p. 10 *Design News*.

Werner, "The Flowering of Flat Displays", May 1997, pp. 40–49 *IEEE Spectrum*.

*Primary Examiner*—David Mis

*Attorney, Agent, or Firm*—Mueller and Smith, LPA

[57] ABSTRACT

A low turn-on voltage volcano-shaped field emitter, a method of fabrication, and integration into an addressable array suitable for applications in field emitter displays and other electron generating applications are disclosed. In one embodiment, the device is fabricated using a stepped insulator in which the distance between the gate and the emitter near the emission surface is significantly reduced with respect to the thickness of the insulator and separates the gate from the emitter. By keeping the large gate-to-emitter distance, the device capacitance is reduced and fabrication yield is increased, since pinholes in the insulator are significantly reduced. In another embodiment of the present invention, the integration of the device into an addressable array suitable for electron emission is described. The array incorporates a network of resistors which assures uniform emission.

27 Claims, 4 Drawing Sheets

LOW TURN-ON VOLTAGE VOLCANO-SHAPED FIELD EMITTER AND INTEGRATION INTO AN ADDRESSABLE ARRAY

CROSS-REFERENCE TO RELATED APPLICATIONS

This application is a continuation-in-part of U.S. application Ser. No. 08/759,725, filed Dec. 15, 1996 now abandoned.

STATEMENT REGARDING FEDERALLY SPONSORED RESEARCH

Not applicable.

BACKGROUND OF THE INVENTION

This invention relates to a field emission device and its integration into an addressable array. Applications are in areas in which a plurality of small cathodes are used as cold electron emission sources such as in field emitter displays (FEDs), electron amplifiers, sensors, electron injection devices, and others.

Most cold electron source arrays consist of conical-shaped conductors or semiconductors that are surrounded by small gates with typical diameters ranging from 0.5 to 1.5 $\mu$m. Metallic cone emitters are disclosed, for example, by C. Spindt in U.S. Pat. No. 3,665,241, and semiconductive cone emitters are described, for example by H. Busta in U.S. Pat. No. 5,227,699, entitled "Recessed Gate Field Emission", issued Jul. 13, 1993. See generally:

(1) Presentations by Silicon Video Corporation, Micron Display Corporation and FED Corporation at the ARPA High Definition Systems Information Conference, Arlington, Va., Apr. 30–May 3, 1995.

(2) J. Levine, "Field Emission Displays," American Vacuum Society Test Panel Display Processing and Research Tutorial, Jun. 21, San Jose, Calif. 1995.

To form these cone arrays, typical photolithographic processing tools as they are used in the manufacture of integrated circuits on eight inch diameter wafers, are employed. Such processing tools include UV light optical steppers and electron beam exposure systems. For arrays that can be fabricated on eight inch diameter substrates, these tools are perfectly adequate. However, for FEDs having principal dimensions of 12" to 20" and larger, adequate photolithographic tools do not yet exist for exposing these small (micron and submicron) gate diameters. See in this regard:

(3) J. P. Spallas et al., "Field Emitter Array Patterning for Large Scale Flat Panel Displays Using Laser Interference Lithography," Technical Digest Eighth Intern. Vacuum Microelectronics Conf., Portland, Oreg., p. 103, 1995.

Fortunately, different field emitter structures exist in which the small spacing between the extraction gate and the emitter is obtained by a thin film deposition step and not by lithography. These devices are typically referred to as volcano-shaped field emitters or as vertical (thin film) edge emitters. A production technique has been proposed wherein these devices are employed to fabricate arrays using printed wiring board-type lithography. See the following publication:

(4) J. E. Pogemiller, H. H. Busta and B. J. Zimmerman, "Gated Chromium Volcano Emitters," J. Vac. Sci. Technology B 12 (2), p. 680, 1993.

Typical examples and emission results of single gated devices are discussed in the following publication, which is incorporated herein by reference:

(5) Busta, et al., "Volcano-shaped Field Emitters for Large Area Displays," IEDM 95 Technical Digest, (The International Electron Devices Meeting), pp. 405–408.

By adding one insulating layer and a metallic layer to the single gated structure, a dual gated structure can be constructed which may exhibit lowered gate current. However, as is apparent, fabrication of such an arrangement becomes more complicated. Such a device is disclosed by Gray and Hsu in U.S. Pat. No. 5,382,185, entitled "Thin-Film Edge Field Emitter Device and Method of Manufacture Therefor," issued Jan. 17, 1995.

Investigators of practical field emitter displays and other cold emission sources have encountered and continue to encounter a variety of technical challenges. As noted above, practicality necessitates fabrication of larger arrays at reasonable cost. The performance capabilities of the field emitter devices should be in consonance with available and practical driver circuitry. This calls for gate-to-emitter structures exhibiting lower capacitance levels adequate to achieve practical turn-on voltages. The physical integrity of the devices also must be assured to achieve stable performance. In this regard, electrode spacing dielectric components must be configured having an extent or thickness sufficient to avoid pinhole phenomena and the like. In contrast, effective device performance calls for closer gate-to-electrode spacing with consequently evolved higher capacitance. Higher capacitance calls for more elaborate and more expensive driver circuits or higher current drive schemes. In further contrast, closer gate-to-electrode spacing serves to reduce required turn-on voltage.

BRIEF SUMMARY OF THE INVENTION

The present invention is addressed to improved edge field emitter devices and their implementation within adjustable arrays as well as the method of their manufacture. These "volcano-type" field emitter devices are so structured as to achieve significant performance improvement, inter alia, in terms of requisite turn-on voltage and in terms of the current demand imposed upon associated driver circuitry. By structuring the discrete devices to incorporate a two region spacing geometry of the emitter electrode with respect to an associated gate electrode, an effective gate-to-emitter capacitance is realized to permit advantageous lower turn-on voltages.

In general, the dual region gate-to-emitter spacing is developed with dielectric layer formations at the sidewall of a protrusion formed upon or within an underlying, supporting substrate with a process employing dual insulative (dielectric) layer formation. The result is a gate-to-emitter spacing in one region adjacent to the top surface or "plateau" of a supporting substrate protuberance which is quite narrow, i.e. from about 0.05 to 0.3 micrometers. Arranged joining with or adjacent to this first region, the profile of the dielectric layer establishes another region thicker than the first region which extends to and typically beyond the base portion of the device. That second region has a thickness both to assure dielectric structural integrity with avoidance of an opportunity for pinhole formations and to develop the noted effective capacitance.

When these edge field emission devices are incorporated within a matrix array, performance advantage is achieved by forming the emitter defining layers of the same material as is used for base-surrounding resistive layers otherwise utilized to evoke a controlling resistance to current flow to dominant emission sites. Some of such commonly employed materials will exhibit a band gap greater than about 2.2 eV. Silicon carbide is a preferred common material for this emitter and resistive region structure.

Another feature and object of the invention is to provide an edge field emitter device which includes a substrate assembly supporting an extraction gate defining protuberance having an electrically conducting gate sidewall extending from a base region to a plateau surface defining region. A rim emitter electrode is provided which is spaced from and supported at the base sidewall and which has a first region spaced from the gate sidewall a first distance and a second region spaced from the gate sidewall a second distance greater than the first distance. A dielectric material is located intermediate the substrate assembly gate sidewall and the emitter electrode.

A further feature of the invention provides a field emitter device which includes a substrate supporting a protuberance having a base region and a sidewall extending outwardly therefrom to a plateau surface. A layer of gate metal is located over and supported upon the substrate at the base region and at the sidewall. A dielectric material layer is located over and supported by the layer of gate metal at the base region and at the sidewall and is configured having a first thickness at a first region adjacent the gate metal layer at the sidewall and has a second thickness greater than the first thickness at a second region adjacent the gate metal at the sidewall and extending toward the base region from the first region. An emitter material layer is supported upon the dielectric material at the first and second regions and extends to a rim in spaced adjacency with the layer of gate metal in the vicinity of the plateau surface to define a rim electrode with the layer of gate metal.

Another feature and object of the invention is to provide an assemblage of field emitter devices arranged in a predetermined pattern upon a substrate and addressable by an applied turn-on voltage from defined matrix array first and second conductive components. The assemblage includes an electrically insulative substrate supporting a sub-assembly of a predetermined number of protuberances arranged in correspondence with the predetermined pattern, each having a base region and a sidewall extending outwardly therefrom to a top surface. A layer of gate metal is located at the base region and extends adjacent the sidewall of each of the protuberances, the gate metal layer being in electrical contact with the matrix array first conductive component. A dielectric material layer is located over the layer of gate metal at the base region and at the sidewall at each protuberance and is configured with a predetermined thickness profile adjacent the sidewall for deriving the turn-on voltage of the devices. An emitter material layer is provided which is supported by the dielectric material layer and is spaced from the layer of gate metal in correspondence with the thickness profile of the dielectric layer. The emitter material layer extends to a rim in spaced adjacency with the layer of gate metal in the vicinity of the top surface of the protuberance to define a rim emitter electrode with the layer of gate metal, the emitter material layer being in electrical contact with the matrix array second conductor component.

Other objects of the invention will, in part, be obvious and will, in part, appear hereinafter.

The invention, accordingly, comprises the apparatus and method possessing the construction, combination of elements, and arrangement of parts and steps which are exemplified by the following detailed disclosure.

For a fuller understanding of the nature and objects of the invention, reference should be had to the following detailed description taken in connection with the accompanying drawings.

DETAILED DESCRIPTION OF THE INVENTION

Figure 1:
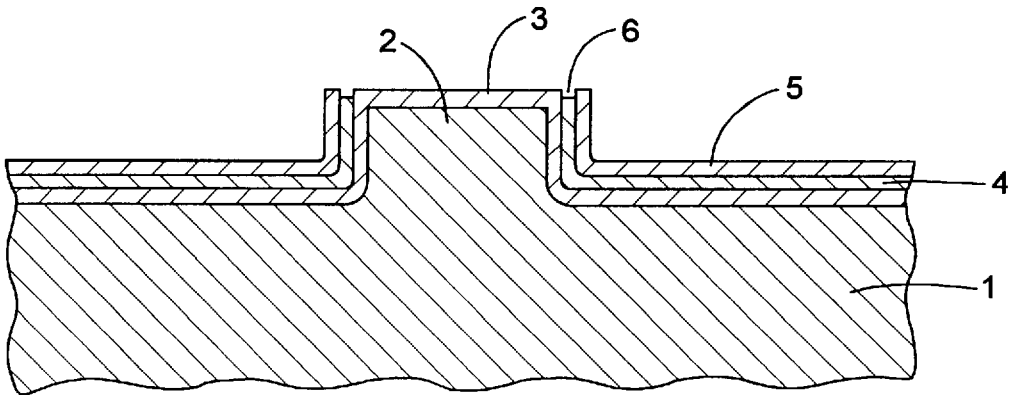
FIG. 1 PRIOR ART
FIG. 1 is a schematic cross-sectional view of one volcano device of the prior art with some components shown in exaggerated fashion.

FIG. 1 shows the cross-section of a single gated prior art device. It consists of a substrate 1 into which gate posts 2 of plateau heights ranging from 1 micrometer to 10 micrometers with diameters ranging from 2 micrometers to 50 micrometers have been etched. If the substrate is insulating such as glass, the gate posts and the top layer of the substrate have to be coated with a thin conductive layer 3. On top of this layer, an insulating layer or film 4, typically $SiO_2$, $Si_3N_4$, $Al_2O_3$, etc., is deposited. On top of the insulating layer, the emissive layer 5 is deposited and defined to form the structure in FIG. 1. Near the emission surface, some of the insulating layer is etched away to form a cavity 6 between the emitter and the gate. This functions to avoid device instabilities occasioned by charges otherwise included within insulating layer 4 in the vicinity of the plateau of gate post 2.

By applying a positive voltage to the gate with respect to the emitter, electrons can escape from the emitter into vacuum space by quantum mechanical tunneling once a critical electric field is obtained. The voltage at which measurable current starts to flow is called the "turn-on" voltage. The field is proportional to the distance between the gate and the emitter. Since the emitter material is deposited at the top of the gate, the dielectric layer between these conductive surfaces as defined by film 4 cannot be made too thin, since pinholes in the dielectric layer can cause shorts between the two layers. In addition, capacitance extant at these two layers (gate-to-emitter) becomes a very significant design parameter. A high capacitance requires more expensive driver circuits. The typical thickness of the dielectric layer ranges from 0.3 micrometers to 1 micrometer. For large displays, to reduce the pinholes, thicker dielectric layers than 1 micrometer are desired.

For a 1 micrometer gap between the emitter and the gate, a turn-on voltage of 240V, for a single gated device recently has been reported by Busta, et al. See publication (5) (supra). Such high turn-on voltages also increase the cost of the driver electronics. It is thus desirable to decrease the turn-on voltage. Ideal, or ultimately desired turn-on voltages would be in the 5-to-10 volts range, since currently available active matrix liquid crystal display (AMLCD) driver chips could be used for display addressing. It may be noted of interest that practical driver electronics performing at slightly higher voltage ranges, i.e. about 25 volts have been realized. To substantially reduce requisite turn-on voltage, without effectively decreasing the dielectric thickness in the regions where the emitter material overlaps or surmounts the wall of the gate conductor, will be beneficial to achieving more practical field emitting devices. Reduction of these turn-on voltages will lead to an employment of the field effect device with more practical circuit topologies and concomitant lower priced display products.

Figure 2:
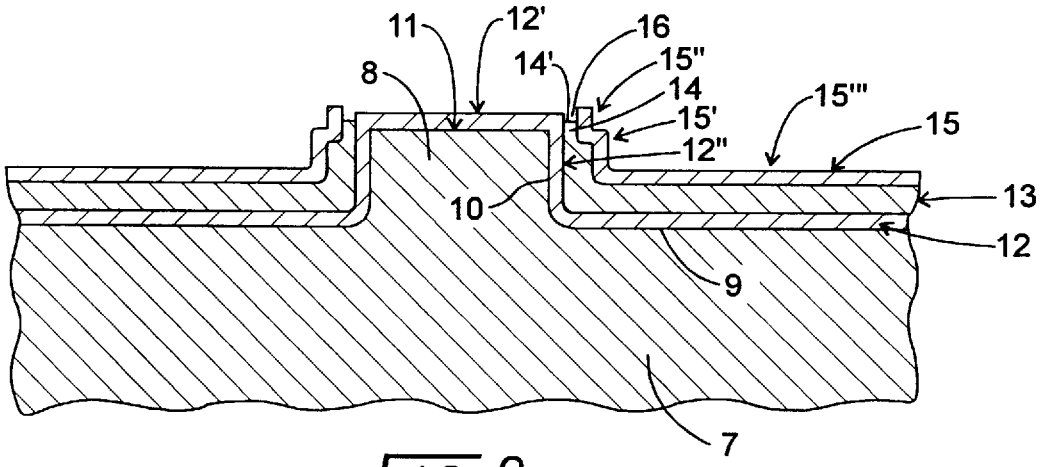
FIG. 2 is a schematic cross-sectional view of a volcano device of the present invention, with some components shown in exaggerated fashion.

FIG. 2 shows the schematic cross-sectional view of one embodiment of the present invention. The device is similar to FIG. 1 (Prior Art). For instance, a substrate 7 is provided having an extraction gate defining protuberance or post 8 extending from a base or substrate forward surface 9. Post 8 is configured with a sidewall or sidewalls 10 which extend upwardly to a plateau 11. The substrate assembly is completed with the deposition thereon of gate metal as shown in general at 12. FIG. 2 shows a distinguishing characteristic of the embodiment in that the emitter material 15 of the device at its rim 15" is brought close to the gate sidewall (10, 12") in the vicinity of the plateau (11, 12') region at the rim of the emitter. By reducing, for instance, the distance between surface 12" and rim 15" from 1 micrometer to 0.3 micrometer, the turn-on voltage of this emitter was reduced from 240 volts to 80 volts, a reduction factor of three, both with respect to the noted gate-to-emitter distance and with respect to the turn-on voltage. An aspect of the linear scaling of these mutually associated parameters thus may be observed.

Looking to its overall structuring, the device consists of the noted substrate 7 with integrally formed gate post 8, gate metal 12 which covers the gate post 8 top surface 11 of the substrate at 12', and sidewall 10 of the post 8 at 12", and a "thick" insulator represented generally at 13. Such an enhanced dielectric thickness readily avoids problems associated with dieletric pinhole phenomena. Note that in addition to exhibiting a thick region, the dielectric extends to a "thin" region to substantially reduce capacitance or effective capacitance for the device. Thickness at the thicker region of the insulator 13 preferably is in a range of about one to twenty micrometers. Near the gate plateau 8, the insulator portion is reduced significantly in its widthwise extent to form a region 14. In this regard, a reduction of insulator 13 thickness from one micrometer to 0.3 micrometer is seen to provide the above-noted desired linear reduction in turn-on voltage (to 80 volts). Accordingly, thicknesses of the insulator which are present at region 14 are provided as about 0.3 micrometers or less. Considering the scaling aspects discussed above, a preferable thickness of dielectric material at region 14 will be about 0.1 micrometer to achieve a turn-on voltage characteristic of about 25 volts. This latter turn-on voltage represents an acceptable value or merger of compatibilities with readily anticipated display driver circuitry.

From the above, it may be observed that the spacing within region 14 between the outer surface of the gate sidewall and the inwardly disposed surface of the emitter preferably has a value of about 0.3 to 0.05 micrometers. An open cavity 16 between the emitter rim and the gate plateau is provided. As shown in FIG. 2, the depth of cavity 16 stops in the thin insulator region 14. However, if the cavity 16 is etched further, for example, below the step-like configuration 15' in emitter layer 15, some of the insulator 13 at the level represented at line 14', below the configuration 12' also would be removed. If this takes place during processing of the device, performance is not sacrificed. Such a window of processing latitude is highly advantageous, performance of the device being maintained, notwithstanding the lowering of level 14'.

From the foregoing, it may be observed that the field emitter device is formed as a substrate assembly with substrate 7 which supports an extraction gate defining protuberance or post 8 with a base 9, and a sidewall 10 surmounting a plateau surface defining region 11. Gate 12 covers this substrate configuration to complete a gate assembly structuring. A rim emitter electrode assembly represented generally at 15 is provided having one region 15" located above the step-like configuration 15' which is spaced from the gate sidewall 12" one distance of about 0.3 to 0.1 micrometers (respective outside surface to inside surface). The emitter electrode extends continuously from configuration 15" along and in adjacency with the gate sidewall 12" to another region 15'" above the base 9 at another distance from gate metal 12 greater than the corresponding distance at region 15". That distance extending to the step-like configuration is selected (gate outside surface to emitter 15 inside surface) as being effective to avoid pin-hole phenomena and the like within an intermediate dielectric material, while not compromising a desired effective gate-to-emitter capacitance derived from the two spacing distances. The developed effective capacitance and electrode spacing achieves a desired turn-on voltage levels. Generally positioned in spacing relationship intermediate the gate metal 12 and emitter material 15 is the dielectric material 13. The lengthwise or heightwise extent of the gate-emitter geometry within region 14, i.e. substantially along the surface of gate material 12", preferably is about 0.2 micrometers as a minimum and may fall within a range of about 0.2 micrometers to 0.4 micrometers.

Figure 3A:
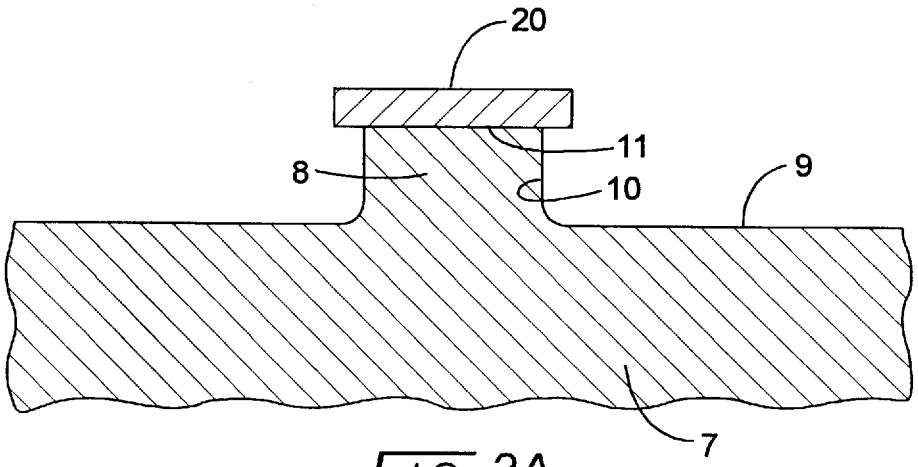
FIGS. 3(*a*)–3(*e*) show a sequence of schematic cross-sectional views of an embodiment of the present invention during different stages of processing, with some components shown in exaggerated fashion.

FIGS. 3(A)–3(E) show several schematic cross-sectional views of the device in FIG. 2 during different stages of processing. Referring to FIG. 3(A), post 8 formation is represented wherein a masking layer 20 is photolithographically defined onto substrate 7. If the substrate 7 is glass, this masking layer 20 could be photoresist or a composite of Cr/Au for instance. Glass is a preferred substrate in that it functions effectively as a base and is in complement with typical, phosphor-carrying glass display surfaces. In this regard, complementary glass-to-glass seals represent a practical vacuum display fabrication aspect. The protuberance or post 8 then is formed either by wet or dry chemical etching. Typical post depths from plateau 11 to base 9 can range from 2 to 20 $\mu$m.

Figure 3B:
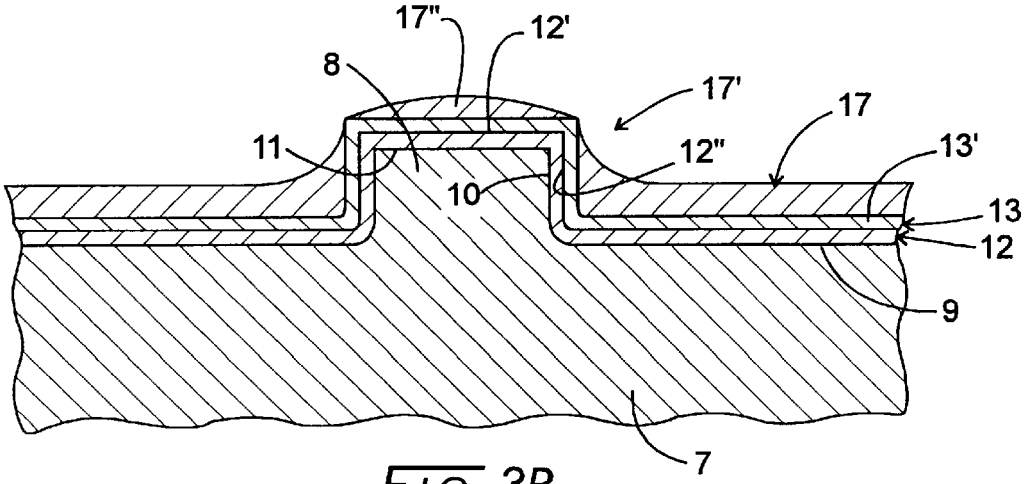
Figure 3C:
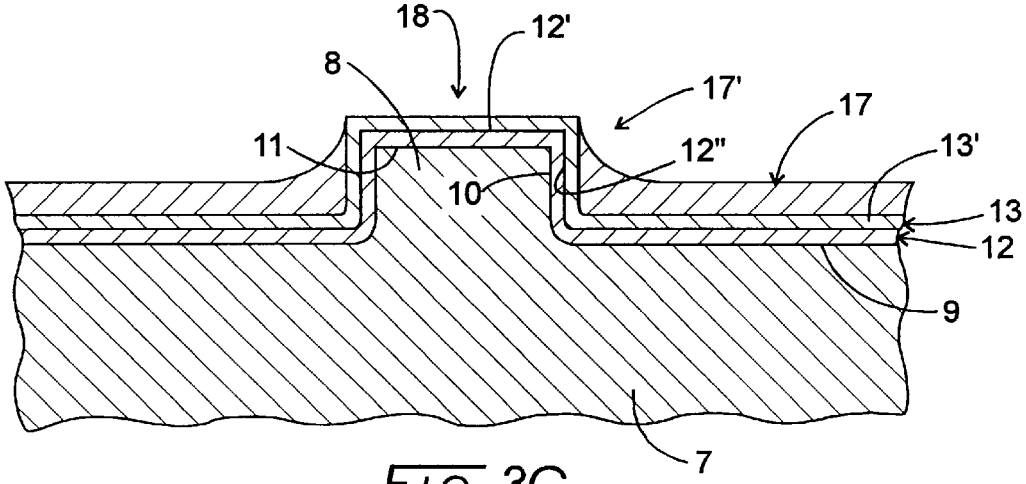

Referring to FIG. 3(B), after removal of the masking layer 20, conductive layer 12 is deposited. Upon this conductive layer 12 there then is deposited an initial insulation or dielectric layer 13' which will provide a portion of the "thick" region of the dielectric material represented generally at 13 in FIG. 2. That general identifying numeration is retained in FIGS. 3(B)–3(E). Following the placement of preliminary dielectric layer 13', photoresist 17 is spun on and the resultant assemblage will appear (exaggerated for clarity) as depicted in FIG. 3(B). The photoresist 17 will pile up upon the sidewall of the post as depicted at 17' and will be thinner on top of the coated top surface or plateau 11 as represented at 17". The exact profile of the photoresist coverage depends on the spin speed, the viscosity of the photoresist, the height, and the diameter of the post 8. To continue processing, the photoresist on top of the plateau, but more importantly at the edge of the plateau, will be removed by an ashing process in an oxygen plasma. After ashing, a profile similar to the one shown in FIG. 3(C) is obtained. Top surface region 18 (FIG. 3(C)) represents the resultant structure where the photoresist at 17" is removed. However, photoresist at 17' will remain disposed above the post sidewalls and the base to support the next occurring procedure. At this point, the preliminary insulating layer 13' is etched to a position of from about 0.2 to 0.4 micrometers from the gate bottom surface 12' which is indicated at 19 in FIG. 3(D). The photoresist 17 (FIG. 3(C)) acts as a protective layer during this process. Prior to the next step, photoresist 17' is removed and the substrate is cleaned.

Figure 3D:
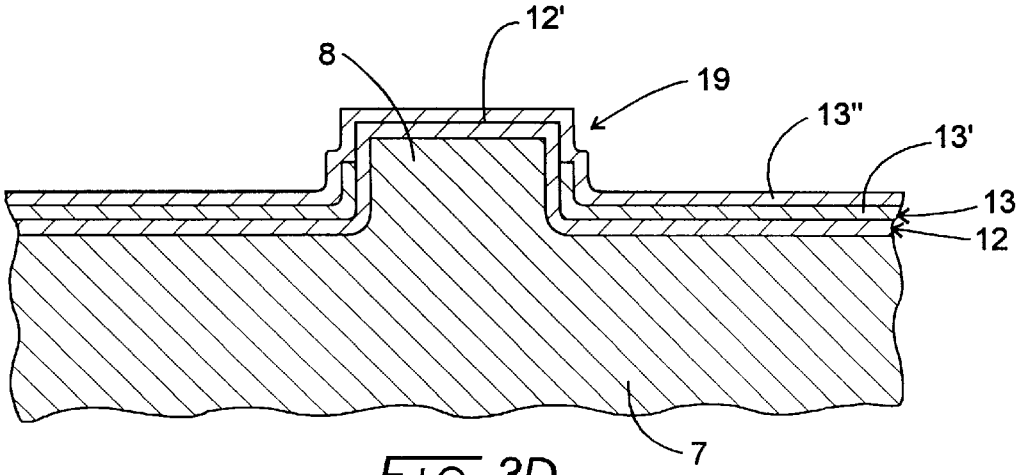
Figure 3E:
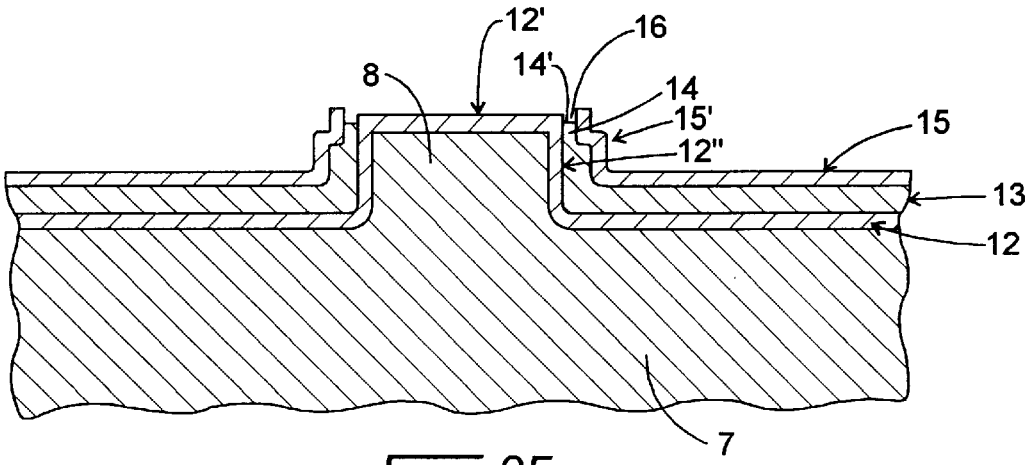

It should be noted that several other options exist in processing this device. One of them includes processing of the device as depicted in FIG. 1. For instance, after removal of layer 5 of the prior art device seen in FIG. 1, the device is at the same stage of processing as described above. Now the thinner gap defining insulating layer 13" is deposited. The schematic cross-sectional view after that processing step is shown in FIG. 3(D). Layer 13" usually is fabricated from the same material as layer 13', but this does not have to be the case. The layer of emitter material 15 is deposited next as represented in FIG. 3(E). The emitter material can consist of a single layer of thin film such as Cr, W, Mo, SiC, AlN, diamond-like films, etc., or a composite layer such as TiW/Au, Cr/Au, or SiC/TiW/Au, etc., or any combination of thin films suitable for electron emission. It may be noted that SiC and the diamond-like films exhibit band gaps greater than 2.2 eV. After emitter deposition, photoresist (not shown) is spun on and ashed away on top of the gate plateau with a process identical to the processing step described in conjunction with FIG. 3(B) and 3(C). After ashing, the emitter material is removed from the top of the post-gate metal 12' structure by wet or dry chemical etching or ion beam milling and cavity 16 is etched. The final device, after photoresist stripping, is shown in FIGS. 2 and 3(E).

Figure 4:
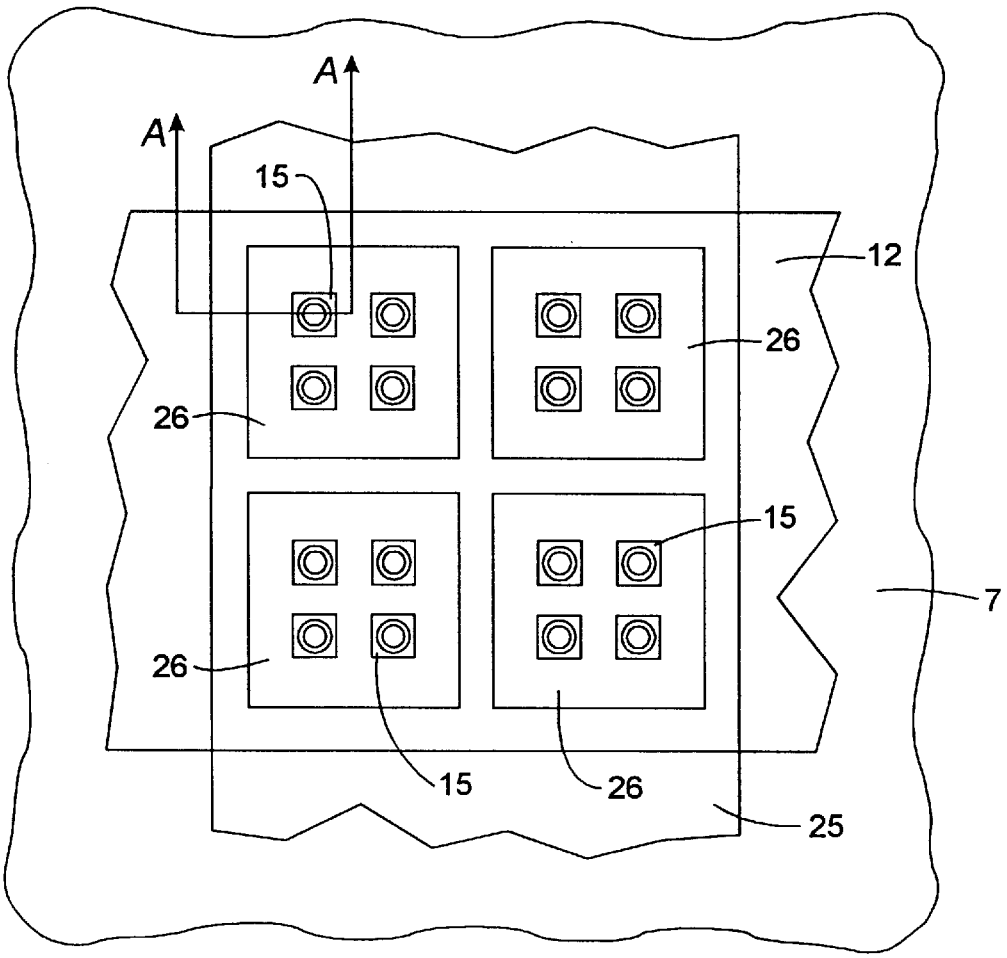
FIG. 4 is a schematic top-view of one subsection of an addressable array using the volcano device according to the present invention, with some components shown in exaggerated fashion.
Figure 5:
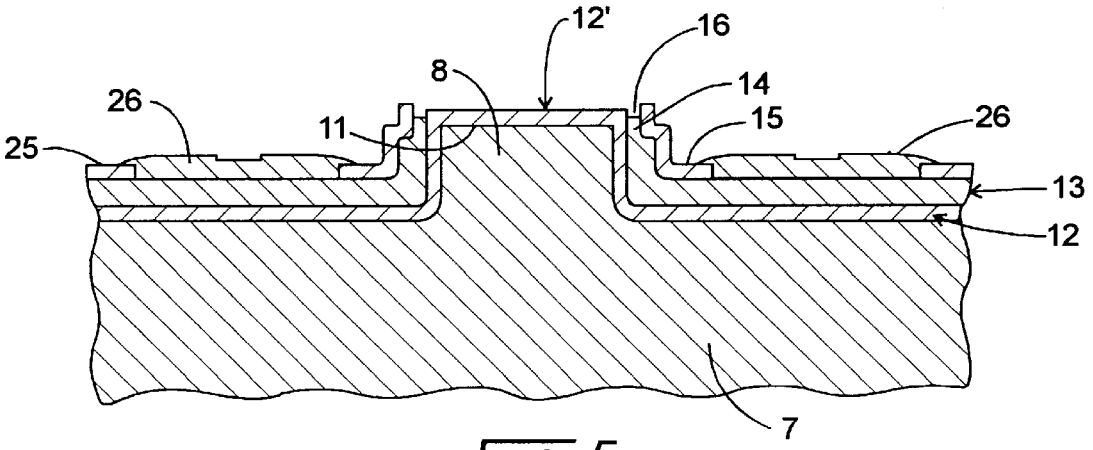
FIG. 5 is a schematic cross-sectional view of an integrated device taken through the plane A—A in FIG. 4, with some components shown in exaggerated fashion.
Figure 6:
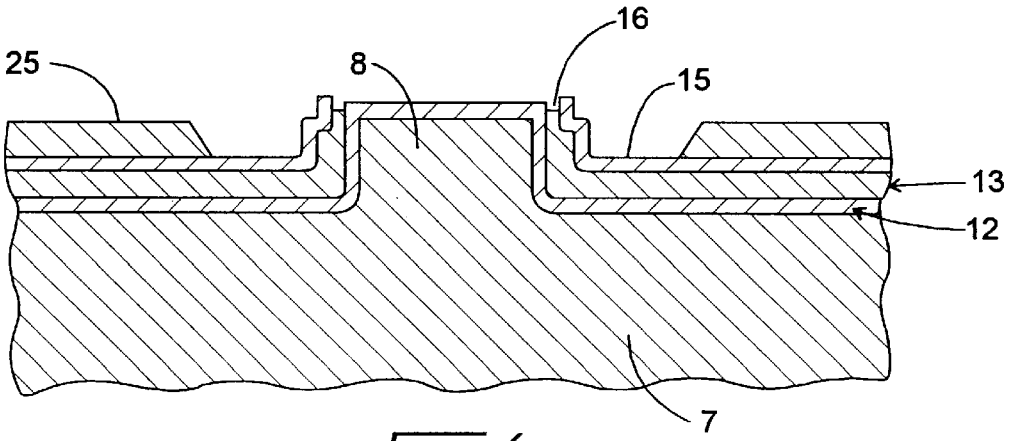
FIG. 6 is a schematic cross-sectional view of an embodiment of the present invention in which the lateral resistor material also is used for the emitter, with some components shown in exaggerated fashion.

Integration of two embodiments of the stepped insulator volcano device into matrix addressable arrays suited for field emitter displays and other applications are disclosed in FIGS. 4, 5, and 6. FIG. 4 shows the top view of an emitter array consisting of sixteen volcano emitters of the present invention in which a bias signal can be applied to all of the gate posts via a gate row 12. In this regard, the common identifying numeration, 12, is retained since the mutual interconnection of the sixteen quad associated gate electrodes with a matrix array component such as a row may be effected with a common conductive material. A signal also is extended to all of the emitter layers 15 via emitter column 25 and interposed resistive networks 26. The application of such a resistive network to field emitter arrays, for example, is disclosed by R. Meyer in U.S. Pat. No. 5,194,780, incorporated herein by reference. The purpose of this resistive layer is to lower the gate voltage of "dominant" emitters by providing a local voltage drop. For the highest current emitting devices, this voltage drop is the largest and thus the effective gate voltage is lowered which reduces the current and lets other emitters in the array contribute to the total current utilization. By grouping four emitters into the resistive network each has the same lateral resistance with respect to an emitter column 25. Dominant emitters are emitters which draw substantially all the current available to an emitter group. The phenomenon, inter alia, results from sharp edged emitter rims, excessively close emitter-to-gate spacings or other artifacts occasioned during manufacture. In general, the resistive regions 26 are formed of amorphous silicon or silicon carbide. For those schooled in the art, it is understood that for many applications, more than four emitter groups as disclosed in FIG. 4 may be used at the intersections of matrix rows and columns.

FIG. 5 shows the schematic cross-sectional view taken through the plane A—A seen in FIG. 4 with dimensional exaggeration in the interest of clarity. Processing is accomplished followed by the stepped oxide process to form regions 13 and 14, followed by the emitter material deposition. When defining the emitter column 25, and the emitters 15, an opening is formed into which the resistive material 26 is deposited and photoshaped. Not shown in these drawings, but known to those skilled in the art, are the formation of contacts to the gate rows and to the emitter columns at the periphery of the array. The way FIG. 5 is disclosed assumes that the emitter 15 is fabricated from the same material as the emitter column 25. In many instances this is not the case. The emitter column 25 preferably is fabricated using a high conductivity material such as copper, gold, aluminum, or even a thick film paste. For the emitters, refractory metals, metal silicides, different carbides, and wide band gap semiconductors, among others might be chosen. The preferred emitter material is silicon carbide, a material which has been found to provide devices exhibiting highly satisfactory stable emission characteristics. This then changes the cross-sectional view of the device in FIG. 5 and the processing sequence. An example of a different materials application is disclosed in FIG. 6.

Referring to FIG. 6, a schematic cross-sectional view of another embodiment of the present invention is disclosed where the emitter material 15 is different from the emitter column material 25. For instance, material 15 can be fabricated using the resistive materials 26 in FIG. 5 such as SiC, diamond-like films, metal-insulator cermets and others. By providing this commonality of emitter material 15 and resistive material 26, very stable emission can be achieved, since the rim of the volcano is fabricated with this common material to thus contribute additional resistance to the gate-emitter circuit. Column defining material 25 is of high conductivity since it has to conduct the current to the volcanoes without causing a significant voltage drop along a line.

Since certain changes may be made in the above apparatus and method without departing from the scope of the invention herein involved, it is intended that all matter contained in the above description or shown in the accompanying drawings shall be interpreted as illustrative and not in a limiting sense.

We claim:

1. An edge field emitter device, comprising:

a substrate assembly supporting an extraction gate defining protuberance having an electrically conductive sidewall extending from a base region to a plateau top surface defining region;

a rim emitter electrode spaced from and supported at said gate sidewall, having a first region spaced from said gate sidewall a first distance and a second region spaced from said gate sidewall a second distance greater than said first distance; and a dielectric material intermediate said substrate assembly gate sidewall and said rim emitter electrode.

2. The edge field emitter device of claim 1 in which said rim emitter electrode first distance and second distance are selected to derive an effective gate-to-emitter distance to effect a turn-on voltage for said device of less than about 80 volts.

3. The edge field emitter device of claim 1 in which said emitter electrode is configured having an inwardly disposed surface generally parallel with said extraction gate sidewall and spaced therefrom a said first distance having a value of about 0.1 to 0.3 micrometers.

4. The edge field emitter device of claim 1 in which said rim emitter electrode is formed as a continuous layer extending from said base region and being stepped inwardly toward said sidewall at a union of said first and second regions.

5. The edge field emitter device of claim 1 in which said dielectric material extends intermediate said rim emitter electrode and said sidewall from said second region to a level partially within said first region to define an inwardly opening gap between said sidewall and the inwardly diposed surface of said rim emitter electrode.

6. The edge field emitter device of claim 1 in which said emitter electrode first region is configured having an inwardly disposed surface generally parallel with said extraction gate sidewall and spaced therefrom a said first distance having a value of about 0.1 micrometers.

7. The edge field emitter device of claim 1 in which said emitter electrode first region extends in spaced adjacency with said sidewall from said plateau surface defining region toward said base region a distance having a value of about 0.2 to 1.0 micrometers.

8. The edge field emitter device of claim 1 in which said emitter electrode second region is configured having an inwardly disposed surface generally parallel with said extraction gate sidewall and spaced therefrom said second distance having a value of about 1 to 20 micrometers.

9. The edge field emitter device of claim 1 in which said rim emitter electrode is formed comprising silicon carbide.

10. The edge field emitter device of claim 1 in which said dielectric material extends intermediate said rim emitter electrode and said sidewall.

11. The edge field emitter device of claim 1 in which said rim emitter electrode first distance is selected as effective to derive field generating electron emission performance at a turn-on voltage less than about 80 volts.

12. A field emitter device, comprising:

a substrate supporting a protuberance having a base region and a sidewall extending outwardly therefrom to a plateau surface;

a layer of gate metal located over and supported upon said substrate at said base region and at said sidewall;

a dielectric material layer located over and supported by said layer of gate metal at said base region and at said sidewall and configured having a first thickness at a first region adjacent said gate metal layer at said sidewall, and having second thickness greater than said first thickness at a second region adjacent said gate metal at said sidewall and extending toward said base region from said first region; and an emitter material layer supported by said dielectric material at said first and second regions and extending to a rim in spaced adjacency with said layer of gate metal in the vicinity of said plateau surface to define a rim electrode with said layer of gate metal.

13. The field emitter device of claim 12 in which said first dielectric material thickness is selected to provide rim field emission from said emitter rim in response to applied turn-on voltages of less than about 80 volts.

14. The field emitter device of claim 12 in which said first and second dielectric material thickness are of respective dimensional values for providing an effective gate-to-emitter distance to provide a turn-on voltage for said device of less than about 80 volts.

15. The field emitter device of claim 12 in which said first dielectric material thickness is about 0.1 micrometers in value.

16. The field emitter device of claim 12 in which said dielectric material second thickness has a value between about 1 and 20 micrometers.

17. The field emitter device of claim 12 in which said emitter material is silicon carbide.

18. The field emitter device of claim 12 in which said emitter material layer is substantially parallel with said layer of gate metal at said sidewall adjacent said first region and has a heightwise extent of about 0.2 to 1.0 micrometers.

19. An assemblage of field emitter devices arranged in a predetermined pattern upon a substrate and addressable by an applied turn-on-voltage from defined matrix array first and second conductor components, comprising:

an electrically insulative substrate supporting a subassembly of a predetermined number of protuberances arranged in correspondence with said predetermined pattern, each having a base region and a sidewall extending outwardly therefrom to a top surface;

a layer of gate metal located at said base region and extending adjacent said sidewall of each said protuberance, said gate metal layer being in electrical contact with said matrix array first conductor component;

a dielectric material layer located over said layer of gate metal at said base region and at said sidewall at each said protuberance and configured with a predetermined thickness profile adjacent said sidewall for deriving the turn-on voltage of said devices; and an emitter material layer supported by said dielectric material layer and spaced from said layer of gate metal in correspondence with said thickness profile and extending to a rim in spaced adjacency with said layer of gate metal in the vicinity of said top surface to define a rim emitter electrode with said layer of gate metal, said emitter material layer being in electrical contact with said matrix array second conductor component.

20. The assembly of claim 19 including a layer of electrically resistive material supported from said substrate and in serial electrical contact intermediate said emitter material layer at said base region and said second conductor component.

21. The assembly of claim 19 in which said electrically resistive material is the same material as said emitter material.

22. The assembly of claim 21 in which said electrically resistive material and said emitter material comprise silicon carbide.

23. The assembly of claim 19 in which said dielectric material layer predetermined profile includes a first thickness at a first region adjacent said gate metal layer at said substrate sidewall and a second thickness greater than said first thickness at a second region adjacent said gate metal layer at said sidewall and extending toward said base region.

24. The assembly of claim 23 in which said first profile thickness at said first region is selected to provide rim field emission from said emitter rim in response to applied turn-on voltages of less than about 80 volts.

25. The assembly of claim 23 in which said first and second profile thicknesses are of respective dimensional values for providing an effective gate-to-emitter distance for providing a turn-on voltage for said devices of less than about 80 volts.

26. The assembly of claim 23 in which said profile first thickness at said first region has a value between about 0.05 and 0.3 micrometers.

27. The assembly of claim 26 in which said profile second thickness at said second region has a value between about 1 and 20 micrometers.

* * * * *